US005396843A

United States Patent [19]

Dürr

[11] Patent Number: 5,396,843

[45] Date of Patent: Mar. 14, 1995

[54] METHOD AND APPARATUS FOR MOUNTING FLEXIBLE PRINTING PLATES ON A FORME CYLINDER

[75] Inventor: Ing. Reinhold R. Dürr, Würzburg, Germany

[73] Assignee: Koenig & Bauer Aktiengesellschaft, Wurzburg, Germany

[21] Appl. No.: 171,172

[22] Filed: Dec. 22, 1993

[30] Foreign Application Priority Data

Dec. 24, 1992 [DE] Germany ..... 42 44 077.7

[51] Int. Cl.[6] ..... B41F 27/12

[52] U.S. Cl. ..... 101/415.1; 101/382.1; 101/383; 101/378

[58] Field of Search ..... 101/415.1, 378, 382.1, 101/383, 384, 385, 386, 387, 388, 389

[56] References Cited

U.S. PATENT DOCUMENTS

| | | | |
|---|---|---|---|
| 3,230,883 | 9/1963 | Achinger . | |
| 3,425,348 | 2/1969 | Hermach et al. | 101/415.1 |
| 3,625,151 | 12/1971 | Hart . | |
| 3,715,981 | 2/1973 | Huffman | 101/415.1 |
| 3,757,691 | 9/1973 | Etchell et al. | 101/415.1 |
| 4,641,576 | 2/1987 | Güthling et al. | 101/415.1 |
| 4,864,931 | 9/1989 | Felkl et al. | 101/415.1 |
| 4,893,561 | 1/1990 | Grosshauser et al. | 101/382.1 |
| 4,938,134 | 7/1990 | Dorsam et al. | 101/415.1 |
| 5,003,878 | 4/1991 | Dorow et al. | 101/378 |
| 5,005,477 | 4/1991 | Schroeder | 101/415.1 |
| 5,110,159 | 5/1992 | Herold et al. | 235/131 |

FOREIGN PATENT DOCUMENTS

| | | |
|---|---|---|
| 1209821 | 9/1959 | France . |
| 1144294 | 9/1963 | Germany . |
| 1172690 | 6/1964 | Germany . |
| 1936396 | 1/1971 | Germany . |
| 2620427 | 6/1978 | Germany . |
| 3731039 | 12/1989 | Germany . |
| 3943119 | 6/1991 | Germany . |

*Primary Examiner*—Edgar S. Burr
*Assistant Examiner*—Lynn D. Hendrickson
*Attorney, Agent, or Firm*—Jones, Tullar & Cooper

[57] ABSTRACT

A method and apparatus for mounting flexible printing plates on a forme cylinder utilizes one or more insert bars that are positioned in cylinder grooves. Each insert bar has a pair of tensioning bars which are biased circumferentially toward each other. An inflatable tube is positioned between the tensioning bars and upon inflation will spread plate engaging hooked ends of the tensioning bars apart from each other.

2 Claims, 3 Drawing Sheets

METHOD AND APPARATUS FOR MOUNTING FLEXIBLE PRINTING PLATES ON A FORME CYLINDER

FIELD OF THE INVENTION

The present invention is directed generally to a method and apparatus for mounting flexible printing plates on a forme cylinder. More particularly, the present invention is directed to a method and apparatus for mounting flexible printing plates on a forme cylinder of a rotary printing press. Most specifically, the present invention is directed to a method and apparatus for mounting flexible printing plates on a forms cylinder using plate tensioning bars that are preloaded into a plate tensioning position. The tensioning bars are supported in an insert bar in an axially extending groove in the forms cylinder. A first end of a printing plate is hooked over an overhanging projection on the insert bar. The second end of the plate is tensioned by being engaged by a hook shaped end of one of the tensioning bars. An inflatable tubular member is placed between the two tensioning bars and is inflatable to spread the tensioning bars circumferentially apart to release tension on the printing plate.

DESCRIPTION OF THE PRIOR ART

A number of generally known prior art devices have been used to secure flexible printing plates on a forms cylinder of a rotary printing press. One such prior art device is shown in the German patent specification No. 11 44 294. In this patent, there is shown a device for securing a flexible printing plate on a forme cylinder of a rotary press. The forme cylinder has a mounting groove, which is parallel to the axis of the forme cylinder, and having two clamping Jaws arranged therein, for gripping the bent-over printing plate ends. An inflatable hose is arranged between the two clamping jaws. In an inflated condition, the hose presses against lower portions of the clamping jaws as well as against shiftable intermediate pieces, which are arranged in a direction parallel to the cylinder axis, and within the clamping jaws, in which there can be clamped, in addition, angled flanges of the already bent-over printing plate ends between the clamping jaws and the intermediate pieces. In this prior device, the clamping jaws are arranged in such a way that they can be pivoted around approximately their central point. The inflatable hose presses against the lower ends of the clamping jaws which have an approximately H-shaped cross section, looking in the direction of the axis of rotation of the forme cylinder.

In this prior art flexible plate clamping assembly, it is necessary for the inflatable tube or hose to remain inflated to exert a securement force on the clamping bars. This means that the plate mounting and clamping device cannot be actuated, when the air pressure supply assembly breaks down, and also means that the printing plates automatically loosen from the forme cylinder in case of pressure loss during operating conditions. In consequence of the tensioning of both printing plate ends, it is not possible to make a fine adjustment of the circumferential register. It is only possible to exchange a worn air hose from the mounting groove on the front side of the forme cylinder, because of the existence of the intermediate pieces. Such a change can only be effected when the forme cylinder is dismounted.

It will thus be seen that a need exists for a method and apparatus for mounting a flexible printing plate which overcomes the limitations of the prior art. The method and apparatus in accordance with the present invention provides such a device and is a significant improvement over the prior art devices.

SUMMARY OF THE INVENTION

It is an object of the present invention to provide a method and apparatus for mounting flexible printing plates on a forme cylinder.

Another object of the present invention is to provide a method and apparatus for mounting flexible printing plates on a forme cylinder of a rotary printing press.

Still a further object of the present invention is to provide a method and apparatus for mounting flexible printing plates on a forme cylinder using plate tensioning bars that are preloaded into a plate tensioning position.

Yet another object of the present invention is to provide a method and apparatus for mounting flexible printing plates on a forme cylinder using an inflatable tube to move the tensioning bars to an unclamping position.

Even still a further object of the present invention is to provide a method and apparatus for mounting flexible printing plates which can be actuated manually as well as by use of an inflatable tube and which is easily accessible and further which allows a register-true mounting of the flexible printing plates on the forme cylinder which may be rotatable in either direction and in which the inflatable tube is required to be inflated only during plate securement or removal.

As will be set forth in detail in the description of the preferred embodiment which is presented subsequently, the method and apparatus for mounting flexible printing plates on a forme cylinder of a rotary press in accordance with the present invention utilizes an insert bar that is secured in an axially extending groove or channel on the peripheral surface of the forme cylinder. The insert bar has a generally U- or channel shape in cross-section and is provided with printing plate bent end engaging overhanging or hang-up projections at the edges of the channel mouth. A pair of plate tensioning bars are placed within the channel in the insert bar. These two tensioning bars are rotatable about first, inner ends that receive torsion bars. These torsion bars bias the two tensioning bars toward each other so that claw or hook shaped outer or second ends of the tensioning bars are biased toward each other in the circumferential direction. An inflatable tube or hose is located between the tensioning bars. Inflation of the hose spreads the outer ends of the tensioning bars circumferentially apart. In use, a first bent end of a flexible printing plate is hooked over one of the overhanging or plate end hang-up projections at the mouth of the channel formed by the insert bar. The second bent end of the plate is hooked over one of the claw-shaped second ends of one of the tensioning bars, these two tensioning bars being held in their spread apart position by the inflated tube. Once the second plate end has been brought into engagement with the tensioning bar, the hose or tube is deflated so that the two outer ends of the two tensioning bars will be moved toward each other under the influence of their respective torsion bars to thereby securely mount the flexible printing plate on the surface of the forme cylinder.

In the present invention, the hose is inflated only during clamping, removal, or adjustment of the plate or plates on the forme cylinder. The tube can be deflated once the clamping has been accomplished. This means that a loss of air pressure will not cause a loosening of the plates on the cylinder, as was the case in the prior art device. If there should be a loss of air pressure, the torsion bars will maintain their force on the tensioning bars so that the flexible printing plate remains securely held in place. The tensioning bars can, if necessary, be shifted manually to their circumferentially spread position, if there should be a loss of air pressure so that the flexible printing plate or plates can be removed from the forme cylinder.

The insert bar is provided with two overhanging or plate hang-up projections, and the plate tensioning assembly uses two tensioning bars. This allows a flexible printing plate to be secured to the forme cylinder so that it will be operable in either rotational direction of the forme cylinder. This is of great significance especially in newspaper printing devices which are able to operate in either rotational direction. This capability of reversible operation greatly increases the number of possible web-guide paths.

The inflatable air hose that is positioned between the two circumferentially shiftable tensioning bars, can be removed from between these two bars. This makes it much easier to replace a worn air hose and to quickly perform maintenance on the plate tensioning assembly without having to dismantle the entire forme cylinder. The two tensioning bars are biased toward each other with a high degree of tensioning force through the use of a relatively small amount of springs. The application of the air hose immediately between the two tensioning bars generates a suitable counterforce to spread the free outer ends of the tensioning bars apart for plate release during the period of application of the plates to, or removal of the plates from, the surface of the forme cylinder.

The method and apparatus for mounting flexible printing plates on a forme cylinder in accordance with the present invention overcomes the limitations of the prior art methods and devices. It represents a substantial advance in the art.

BRIEF DESCRIPTION OF THE DRAWINGS

While the novel features of the method and apparatus for mounting flexible printing plates on forme cylinders in accordance with the present invention are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENT

Figure 1:
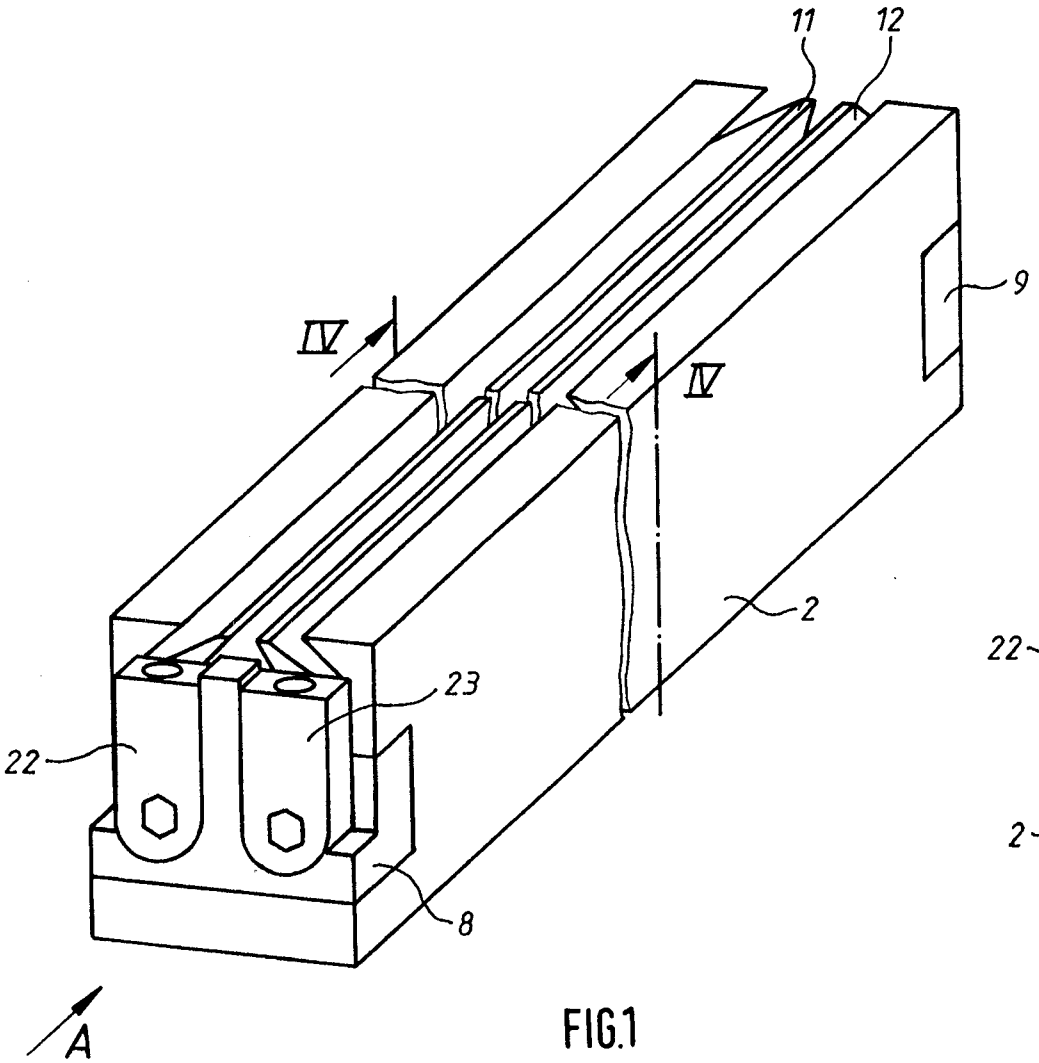
FIG. 1 is a perspective view of the insert bar for use in the present invention.

Referring initially to FIG. 1, there may be seen generally at 2, an insert bar in accordance with the present invention. As may be seen somewhat schematically in FIGS. 4 and 5, insert bar 2 is positionable in a groove or slot in the peripheral surface of a forme cylinder, generally at 1, of a rotary printing press. It will be understood that the forme cylinder 1 is generally conventional and is part of a generally conventional rotary printing press which will not be disclosed in great detail since it does not form a part of the present invention. The groove or slot on the peripheral surface of the forme cylinder 1 extends in the axial direction of the forme cylinder 1. The insert bar 2 is removably secured in the groove or slot in a suitable manner. As may be seen in FIG. 3 the insert bar 2 may be provided with holes 42 in its bottom surface with these holes 42 being capable of receiving screws or other fasteners that will secure the insert bar 2 in the groove or slot in the forme cylinder 1.

Figure 5:
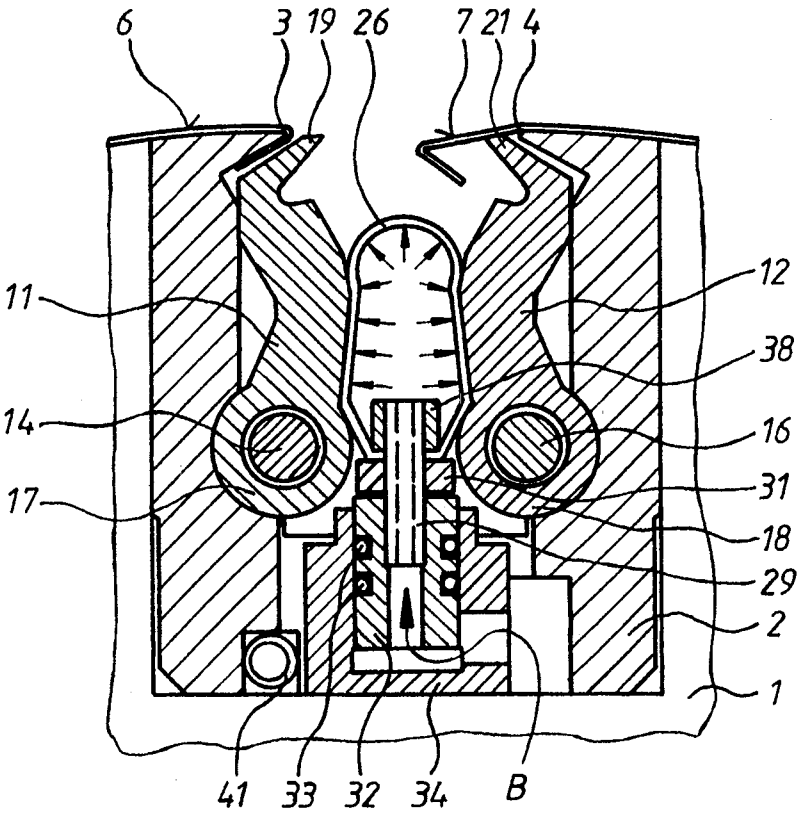
FIG. 5 is a view similar to FIG. 4 and showing the pressure exerting hose in its inflated position to bias the tensioning bars apart.
Figure 4:
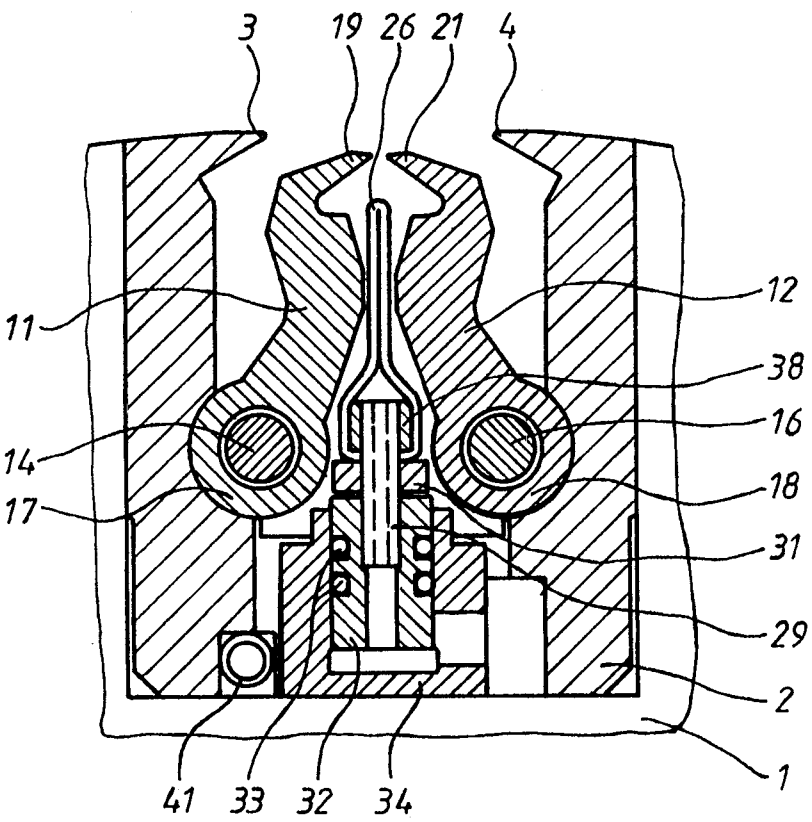
FIG. 4 is an end cross-sectional view of the insert bar and tensioning bars of the present invention, taken along line IV—IV of FIG. 1 and showing the tensioning bars in their plate clamping positions in which the tube is deflated.

Insert bar 2 is, as may be seen most clearly in FIGS. 4 and 5, generally U-shaped or channel-shaped in cross-section. The upper ends of the radially extending webs of the channel that is the insert bar 2 have circumferentially spaced, axially extending, inwardly facing printing plate hang-up or overhanging projections 3 and 4. These hang-up projections are generally wedge-shaped and have free edges. As seen in FIG. 5, each hang-up projection 3 or 4 is shaped to cooperatively receive a bent end of a flexible printing plate, such as plate, or plate end 6 or 7, which is to be secured to the periphery of the forme cylinder 1 by use of the flexible printing plate mounting apparatus of the present invention.

Referring again to FIG. 1, a pair of bearing brackets 8 and 9 are provided on the end faces of the insert bar 2. These bearing brackets 8 and 9 support the ends of two generally parallel, axially extending plate tensioning bars 11 and 12. These tensioning bars are supported at their ends by the bearing brackets which are, in turn, supported in the end faces of the insert bar 2. As may be seen in FIG. 3, a pair of hexagon headed screws 10 are used to secure the bearing brackets 8 and 9 to the end faces of the insert bar.

Figure 2:
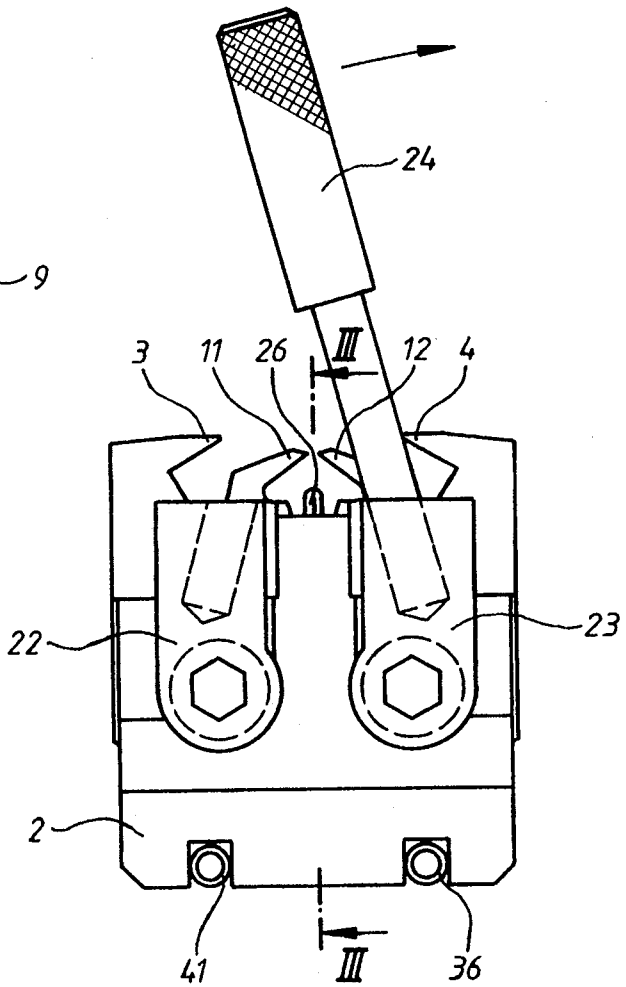
FIG. 2 is an end elevation view of the insert bar showing the use of a manual actuation tool, and taken in the direction indicated by arrow A in FIG. 1.

The two tensioning bars 11 and 12 are rotatably supported along first or inner ends 17 and 18, respectively in side walls of the radially extending webs of the insert bar 2, and are preloaded in relation to the bearing brackets 8 and 9 in the direction of rotation toward a plane of symmetry defined by the line III—III in FIG. 2 at their inner or first ends 17 and 18 which are located near to the cylinder, looked at in the cross-section, by means of torsion bars 14 and 16, as seen in FIG. 4. The tensioning bars 11 and 12 have claw-shaped outer or second ends 19 and 21. These outer ends 19 and 21 are shown in their rest position as depicted in FIG. 4. In the first bearing bracket 8 which is positioned on the end face of bar 1, there is arranged a tensioning lever 22 or 23 for the manual actuation of each of the tensioning bars 11 and 12. Each of these tensioning levers extends in the radial direction of cylinder 1 and is connected form-fit with its cooperating torsion bar 14 or 16. By means of a tool 24, the tensioning bars 11 and 12 can be opened against their moment of preload as is shown in FIG. 2. Thus if it is necessary to manually rotate one of the tensioning bars 11 or 12 against the bias of its respective torsion bar 14 or 16, this can be accomplished by sliding an end of the manual tool 24 into a cooperatively shaped bore in the appropriate tensioning or actuating lever 22 or 23 and exerting a force on the free end of the tool 24 to turn the tensioning bar to whose end it is secured.

Figure 3:
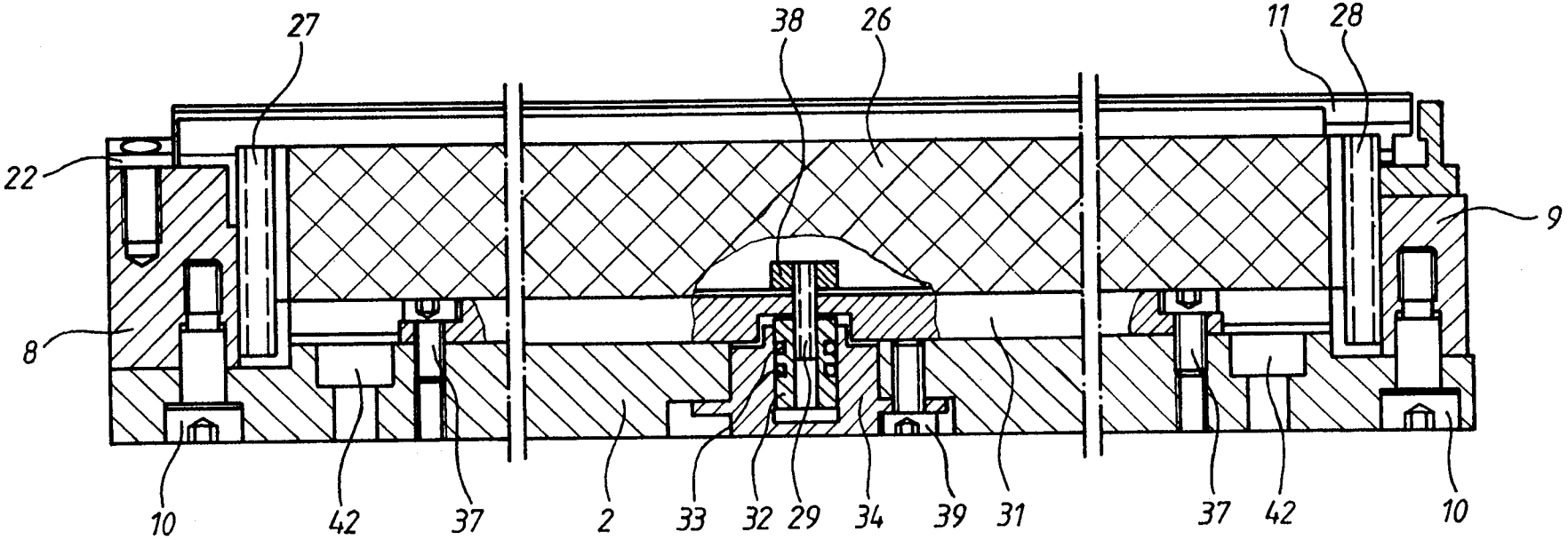
FIG. 3 is a cross-sectional view of the insert bar in accordance with the present invention and taken along the line III, as seen in FIG. 1.

An inflatable hose or tube 26, which can be inflated by a suitable pressure medium such as compressed air, is located between the two tensioning bars 11 and 12, as may be seen in FIGS. 3–5 and acts as an auxiliary energy source to separate the tensioning bars. The hose 26 extends along the interior of the channel defined by the insert bar 2 generally between the two tensioning bars 11 and 12. The axially spaced ends of hose 26, which are situated generally adjacent the bearing brackets 8, are secured to longitudinally extending guides 27 and 28 which are, in turn, received in slots in the axially inner faces of the insert bar 2, as may be seen in FIG. 3. The inflatable hose 26 is securely positioned between the tensioning bars 11 and 12, as may be seen most clearly in FIGS. 4 and 5. This position is such that upon inflation of the tube 26 the two tensioning bars 11 and 12 will be spread circumferentially apart, as seen in FIG. 5. If the tube 26 is deflated, the two tensioning bars 11 and 12 move circumferentially toward each other.

The hose 26 is provided on its underside, and approximately in its middle, with a connecting tube 29, such as a threaded pin with a bore, which is guided through a fastening bar 31 for the hose 26 as seen in FIGS. 3–5, and which is connected with a sleeve 32, that is provided, at its circumference, with several sealing rings 33 which are spaced from each other. This sleeve 32 is joined to a flange 34, that is, in turn, arranged in the lower part of the insert bar 2, and that is in connection with a pneumatic hose 36. As seen in FIG. 2, hose 36 extends in a groove along the underside of the insert bar 2; i.e. between the base of the insert bar 2 and the bottom of the groove in cylinder 1. The sleeve 32, with the sealing rings 33, serves as an airtight, quick-acting connection to the flange 34. The pneumatic hose 36 shown in FIG. 2 is in connection through the forme cylinder 1 to a known air supply systems, by a generally known rotating union of the type shown in German document No. DE 39 43 119 C1 through an axle journal of the forme cylinder 1, as well as through a not shown valve. The fastening bar 31 is fixed by means of screws 37 in the lower part of the insert bar 2. The connecting tube 29 can be fixed by means of a nut 38 in the hose 26. The flange 34 can be fixed by means of a screw 39 in the lower part of the insert bar 2.

In their rest position, in which the tube 26 is not inflated, the tensioning bars 11 and 12 have the position shown in FIG. 4. In this position, the printing plate 6 is placed on cylinder 1 with its bent-over edge engaging the hang-up projection 3 as seen in FIG. 5. For securing or for removing the printing plate 6, the hose 26 is filled with compressed air flowing in the direction of arrow B in FIG. 5, at a pressure of 6 to 8 bar. The hose 26 inflates and its pressure force causes the tensioning bars 11 and 12 to swivel against the moment of preload of the torsion bars 14 and 16, so that the bent-over end of the printing plate 7, as shown in FIG. 5, freely abuts on the second end 21 of the tensioning bar 12. In this position of the tensioning bars 11 and 12, the printing plate can be removed from the cylinder 1 or can be tensioned on the cylinder by deflation of the hose 26 through a valve. The air escapes opposite to the direction of the arrow B in FIG. 5.

With the device according to the invention, there can be applied one single printing plate 6 or 7 onto the circumference of the forme cylinder 1. More typically two plates 6 and 7 are secured in the circumferential direction to the forme cylinder 1. For this case, there are to be provided two insert bars 2. Usually, there are applied in the axial direction of the forme cylinder 1 and onto the same, four printing plates 6 and 7 adjacent each other. This can be performed with an arrangement of the two insert bars 2 on the forme cylinder 1. A second pneumatic hose 41, arranged in a groove at the underside of the insert bar 2, is provided for supplying the air to the second insert bar 2, arranged in the axial direction in the groove on the forme cylinder 1. Thus it is possible to place two or more similar insert bars 2 in the groove or slot on the peripheral surface of the forme cylinder 1 and to provide a separate compressed air supply tube 36 or 41 to each such insert bar 2, as is shown in FIG. 2. There may also be placed insert bars 2 on diagonally opposing surfaces of the forme cylinder 1 in the situation where more than one plate cylinder is placed around the circumference of the forme cylinder.

Referring again to FIG. 5 and assuming that there is only one plate 6 on the surface of the forme cylinder 1, the leading bent over edge of the plate is placed over the hang-up projection 3 of the insert bar 2 and the plate is wrapped around the forme cylinder 1. The tube 26 which was initially deflated, as seen in FIG. 4 to allow the bent end of the plate to be placed over the hang-up projection 3, is now inflated, as seen in FIG. 5 to move the free outer ends of the tensioning bars 11 and 12 circumferentially apart. The trailing edge of the plate 6, which is referenced here as 7 for clarity, is placed in the gap between the free ends of the tensioning bars 11 and 12. The tube 26 will now be deflated to allow the torsion bars 14 and 16 to restore the tension bars 11 and 12 to their positions, as shown in FIG. 4. This will cause the hook shaped end 21 of the tensioning bar 12 to engage the bent trailing edge 7 of the plate 6 and to properly tension and hold the plate on the forme cylinder 1. It will be noted that the plate is held by the mechanical force applied to the tensioning bar 12 by the torsion bar 16 and not by the inflation of the tube 26. The tube 26 is inflated only to move the tensioning bars 11 and 12 circumferentially apart so that the plate or plates can be placed on, taken off or properly aligned on the surface of the forme cylinder 1.

If the forme cylinder 1 is to be rotated in the reverse direction from that previously discussed, the leading edge of the plate will be placed over the hang up projection 4 and the trailing edge of the plate will be engaged by the hook-shaped free end 19 of the tensioning bar 11. Thus the flexible printing plate mounting apparatus of the present invention can be used equally well with either rotational direction of the forme cylinder 1.

As has been discussed previously, the inflatable tube 26 is preferably supplied with compressed air through the tube 36 or 41 from a suitable supply source. This compressed air is typically supplied at a pressure of 6–8 bar. It is within the scope of the present invention, however, to use an alternate pressure fluid. For example, the inflatable tube 2 could be filled with a hydraulic fluid instead of compressed air. This fluid could be supplied from a suitable source of hydraulic fluid.

While a preferred embodiment of a method and apparatus for mounting flexible printing plates on a forme cylinder of a rotary press in accordance with the present invention has been set forth fully and completely hereinabove, it will be apparent to one of skill in the art that a number of changes in, for example, the size of the forme cylinder, the length of the printing plate, the means for supporting the plate cylinder for rotation and the like could be made without departing from the true spirit and scope of the present invention. Accordingly, the invention is to be limited only by the following claims.

I claim:

1. An apparatus for use in mounting flexible printing plates on a forme cylinder, said apparatus comprising:

a forme cylinder supported for rotation about an axis of rotation and having an axially extending groove on a peripheral surface of said forme cylinder;

a generally channel shaped insert bar secured in said cylinder groove and having first and second spaced, radially extending channel webs;

first and second axially extending overhanging printing plate end engaging projections on upper ends of said first and second channel webs adjacent said peripheral surface of said forme cylinder, one of said first and second projections being usable to receive a first end of a flexible printing plate to be mounted on said forme cylinder;

first and second spaced, axially extending tensioning bars having first, inner ends rotatably supported in said insert bar and having second, free ends with printing plate hang-up projections, one of said first and second hang-up projections being usable to receive a second end of a flexible printing plate to be mounted on said forme cylinder;

bearing brackets secured to first and second ends of said insert bar and supporting axial ends of said first and second tensioning bars;

first and second torsion bars preloading said first and second tensioning bars to force said free ends of said first and second tensioning bars toward each other to tension a flexible printing plate on said forme cylinder; and an inflatable hose positioned in said insert bar and extending axially between said first and second tensioning bars, said inflatable hose being inflatable to separate said free ends of said first and second tensioning bars against said preloading forces applied by said first and second torsion bars to untension a flexible printing plate on said forme cylinder.

2. The apparatus for use in mounting flexible printing plates in accordance with claim 1 further including first and second manually actuable tensioning levers secured to said axial ends of said first and second tensioning bars.

* * * * *